US010512301B2

(12) United States Patent
Peyton

(10) Patent No.: US 10,512,301 B2
(45) Date of Patent: Dec. 24, 2019

(54) CUSHIONING ASSEMBLY FOR AN ARTICLE OF FOOTWEAR

(71) Applicant: NIKE, Inc., Beaverton, OR (US)

(72) Inventor: Lee D. Peyton, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 437 days.

(21) Appl. No.: 14/820,023

(22) Filed: Aug. 6, 2015

(65) Prior Publication Data

US 2017/0035146 A1 Feb. 9, 2017

(51) Int. Cl.

*A43B 13/20* (2006.01)
*A43B 13/04* (2006.01)
*A43B 13/18* (2006.01)

(52) U.S. Cl.

CPC ..... *A43B 13/20* (2013.01); *A43B 13/04* (2013.01); *A43B 13/187* (2013.01)

(58) Field of Classification Search

CPC ..... A41F 15/007; A42B 3/12; A43B 13/18; A43B 13/186; A43B 13/187; A43B 13/188; A43B 13/189; A43B 13/20; A43B 13/206; A43B 21/265; A43B 21/28; A43B 13/04; A43B 13/125; A43B 13/127; A43B 17/026; A43B 17/03; A45F 2003/122; A47B 91/002; A47C 7/18; A47C 27/081; A47C 27/10; A47C 7/021; A47C 27/085; A47C 27/144; B65D 81/022; B65D 81/133

USPC ..... 36/29; 428/178; 5/248, 267; 206/521, 206/589, 586, 522; 383/3

See application file for complete search history.

(56) References Cited

U.S. PATENT DOCUMENTS 2,090,881 A * 8/1937 Wilson ..... A43B 13/20 36/29
3,589,037 A * 6/1971 Gallagher ..... A43B 17/03 36/4
4,183,156 A 1/1980 Rudy
4,219,945 A 9/1980 Rudy
4,605,582 A * 8/1986 Sias ..... A61G 7/05707 428/120
4,845,863 A * 7/1989 Yung-Mao ..... A43B 1/0072 36/114
4,880,125 A * 11/1989 LeBeau ..... A61J 9/001 215/11.3
4,936,029 A 6/1990 Rudy
(Continued)

FOREIGN PATENT DOCUMENTS

KR 20090009559 U * 9/2009 ..... B65D 81/03
WO 0170064 A2 9/2001

*Primary Examiner* — Anna K Kinsaul
*Assistant Examiner* — F Griffin Hall
(74) *Attorney, Agent, or Firm* — Quinn IP Law

(57) ABSTRACT

A cushioning assembly for an article of footwear includes a first bladder wall and a second bladder wall disposed opposite the first bladder wall. At least one of the first bladder wall and/or the second bladder wall defines a plurality of domes defining a fluid-filled cavity between the first bladder wall and the second bladder wall. The domes include a base portion defining a generally hemispherical segment having a base radius, and a cap portion defining a generally hemispherical cap having a cap radius. The cap radius is less than the base radius. The cushioning assembly may include a load distribution structure positioned adjacent the cap portions of the domes to distribute an applied load across the domes.

24 Claims, 5 Drawing Sheets

(56) References Cited

U.S. PATENT DOCUMENTS 4,999,931 A * 3/1991 Vermeulen ..... A43B 13/185 36/153
5,042,176 A 8/1991 Rudy
5,274,846 A * 1/1994 Kolsky ..... A41D 13/0156 2/16
5,607,749 A * 3/1997 Strumor ..... A43B 7/146 297/DIG. 8
D378,968 S * 4/1997 Martin ..... D24/212
5,669,161 A * 9/1997 Huang ..... A43B 1/0009 36/29
5,713,141 A 2/1998 Mitchell et al.
5,836,027 A * 11/1998 Leventhal ..... A47C 27/18 5/654
5,873,464 A * 2/1999 Haley ..... B65D 81/03 206/398
5,952,065 A 9/1999 Mitchell et al.
6,013,340 A 1/2000 Bonk et al.
6,029,962 A * 2/2000 Shorten ..... A43B 13/181 267/145
6,082,025 A 7/2000 Bonk et al.
6,127,026 A 10/2000 Bonk et al.
6,203,868 B1 3/2001 Bonk et al.
6,279,300 B1 * 8/2001 Simhaee ..... B29C 51/225 53/453
6,321,465 B1 11/2001 Bonk et al.
6,385,864 B1 * 5/2002 Sell, Jr. ..... A43B 13/181 36/29
6,402,879 B1 * 6/2002 Tawney ..... A43B 13/20 156/285
6,434,859 B1 * 8/2002 Kim ..... A43B 7/142 36/141
6,457,261 B1 * 10/2002 Crary ..... A43B 13/181 36/114
6,601,720 B2 * 8/2003 Meyers ..... A61J 9/001 215/11.3
6,696,135 B2 * 2/2004 Simhaee ..... B29C 53/16 428/166
6,777,062 B2 * 8/2004 Skaja ..... B32B 3/26 428/143
6,931,764 B2 * 8/2005 Swigart ..... A43B 13/20 36/29
7,089,690 B2 * 8/2006 Krstic ..... A43B 3/0042 36/141
7,673,351 B2 * 3/2010 Copeland ..... A41D 31/005 2/425
7,784,196 B1 * 8/2010 Christensen ..... A43B 13/184 36/29
7,930,839 B2 * 4/2011 Litchfield ..... A43B 13/203 36/29
8,029,060 B2 * 10/2011 Parker ..... A47C 1/023 297/300.1
8,061,060 B2 * 11/2011 Swigart ..... A43B 13/181 36/28
8,166,673 B2 * 5/2012 Sills ..... A43B 1/0072 36/29
8,231,756 B2 * 7/2012 Kim ..... A41D 31/005 156/247
8,572,783 B2 * 11/2013 Moutafis ..... A61G 7/05769 5/654
8,590,079 B2 * 11/2013 Habegger ..... A61G 7/05715 5/655.3
8,777,191 B2 * 7/2014 Kligerman ..... F16F 1/373 188/371
8,827,371 B2 * 9/2014 Brncick ..... B60N 2/66 297/452.41
8,904,584 B2 * 12/2014 Sugano ..... A47C 27/00 5/652
9,119,439 B2 * 9/2015 Brandt ..... A43B 13/20
9,279,258 B2 * 3/2016 Cormier ..... E04F 15/225
9,398,779 B2 * 7/2016 Turner ..... A41D 13/0156
9,451,795 B2 * 9/2016 Krueger ..... A42B 3/122
9,474,313 B2 * 10/2016 Kamradt ..... F16F 3/093
9,603,407 B2 * 3/2017 Kanous ..... A42B 3/124
9,603,415 B2 * 3/2017 Taylor ..... B29D 35/122
9,675,122 B2 * 6/2017 Turner ..... A41D 13/015
9,707,141 B2 * 7/2017 Bobey ..... A61G 7/00
2002/0050077 A1 * 5/2002 Wang ..... A43B 1/0072 36/28
2005/0040684 A1 * 2/2005 Yoshiguchi ..... A45F 3/12 297/228.13
2008/0005929 A1 * 1/2008 Hardy ..... A43B 13/188 36/29
2009/0100705 A1 * 4/2009 Cook ..... A43B 13/026 36/29
2009/0274880 A1 * 11/2009 Iwasaka ..... B65D 81/03 428/178
2010/0089858 A1 * 4/2010 Jones-Francis ..... A61J 9/001 215/11.1
2010/0094184 A1 * 4/2010 Wong ..... A43B 13/203 601/149
2010/0193521 A1 * 8/2010 Hasegawa ..... A47J 27/09 220/316
2011/0131832 A1 6/2011 Brandt et al.
2011/0277916 A1 * 11/2011 Beye ..... A43B 13/20 156/145
2012/0073160 A1 * 3/2012 Marvin ..... A43B 13/186 36/28
2012/0104009 A1 * 5/2012 Fascio ..... B65D 65/466 220/694
2012/0220907 A1 * 8/2012 Zinn ..... A61H 19/34 601/46
2012/0233878 A1 * 9/2012 Hazenberg ..... A43B 13/20 36/29
2013/0167401 A1 * 7/2013 Christensen ..... A43B 13/184 36/29
2013/0212909 A1 * 8/2013 Bates ..... A43B 13/189 36/102
2013/0276329 A1 * 10/2013 James ..... A43B 13/189 36/83
2013/0316886 A1 * 11/2013 Lynch ..... A63B 26/003 482/146
2014/0196308 A1 * 7/2014 Baratta ..... A43B 13/184 36/29
2014/0228882 A1 * 8/2014 Randolph ..... A61J 11/0035 606/236
2014/0300093 A1 * 10/2014 Bellemakers ..... B60R 21/26 280/741
2014/0331517 A1 * 11/2014 Seo ..... A43B 7/1405 36/28
2015/0033577 A1 2/2015 Dahl et al.
2015/0164172 A1 * 6/2015 Linares ..... A42B 3/065 2/411
2015/0230511 A1 * 8/2015 Blankenship ..... B01F 15/0243 426/477
2015/0290087 A1 * 10/2015 Kirkland ..... A61J 11/02 215/11.5
2015/0337868 A1 * 11/2015 Hashida ..... F15B 1/04 138/30
2015/0366281 A1 * 12/2015 Miller ..... B32B 27/12 428/136
2016/0024812 A1 * 1/2016 South ..... E04B 1/166 52/2.18
2016/0242502 A1 * 8/2016 Spanks ..... A43B 13/20
2016/0295967 A1 * 10/2016 Campos, II ..... A43B 13/20
2016/0324666 A1 * 11/2016 Barberio ..... A61F 2/7812

* cited by examiner

FIG. 2
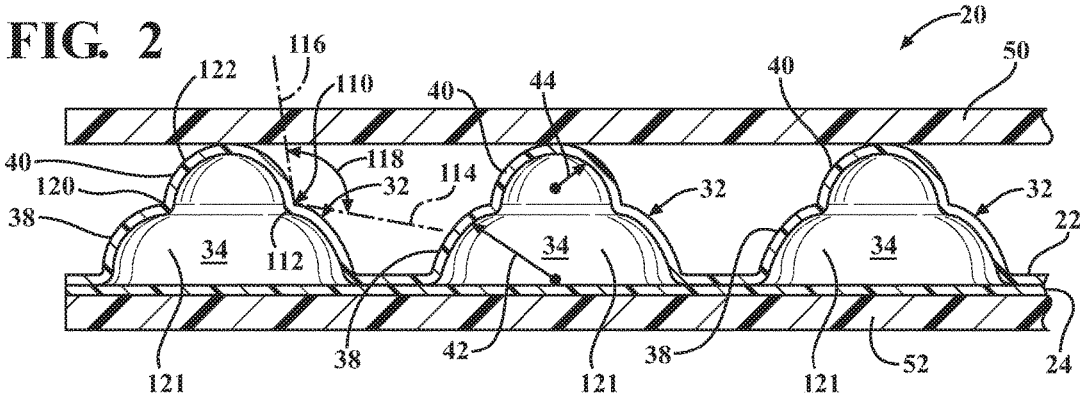
FIG. 3
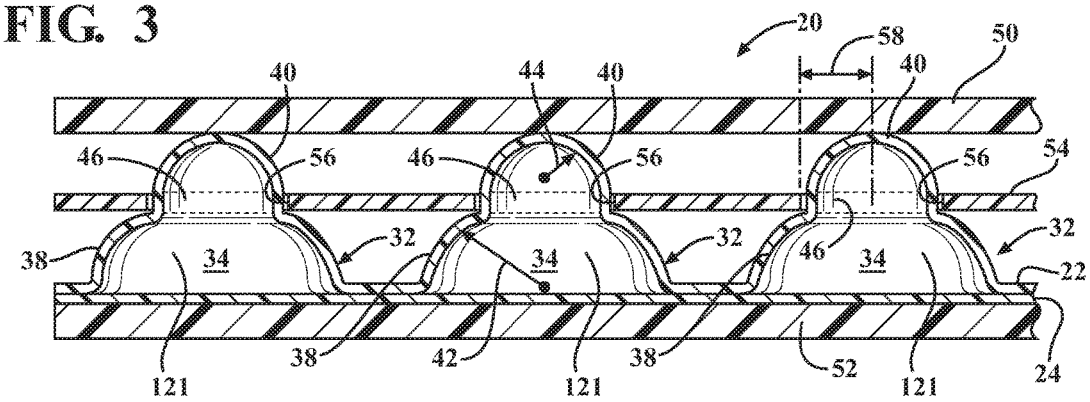
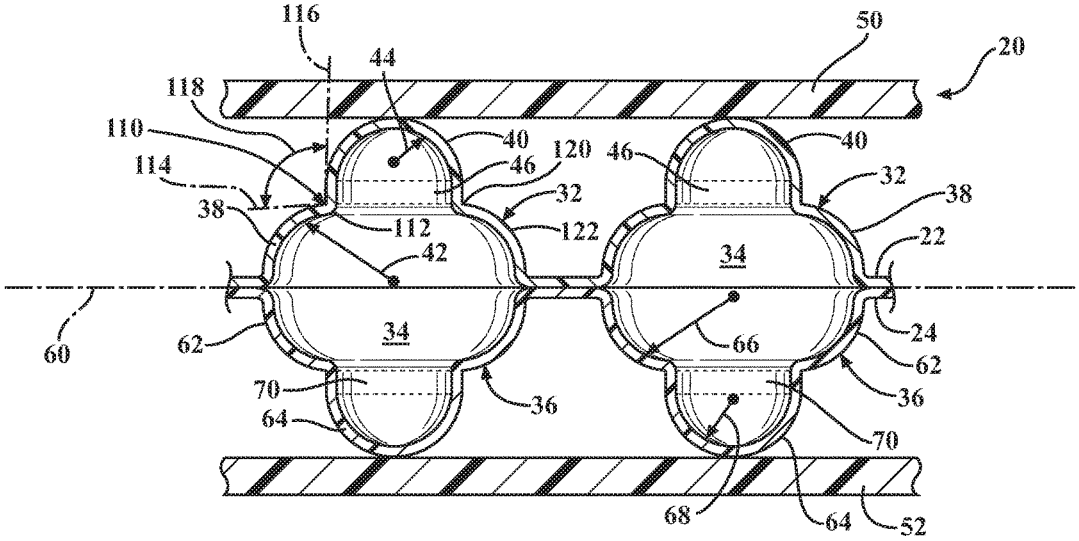
FIG. 4

CUSHIONING ASSEMBLY FOR AN ARTICLE OF FOOTWEAR

TECHNICAL FIELD

The present disclosure generally relates to a cushioning assembly for an article of footwear

BACKGROUND

Footwear typically includes a midsole located under a wearer's foot to provide cushioning for the wearer. The midsole may be manufactured from a polyurethane foam or other resilient materials. The midsole may include a cushioning assembly that defines one or more fluid-filled cavities to provide enhanced cushioning characteristics.

BRIEF DESCRIPTION OF THE DRAWINGS

FIG. 2 is a schematic cross sectional view of a first embodiment of the cushioning assembly.

FIG. 3 is a schematic cross sectional view of a second embodiment of the cushioning assembly.

FIG. 4 is a schematic cross sectional view of a third embodiment of the cushioning assembly.

DETAILED DESCRIPTION

Figure 1:
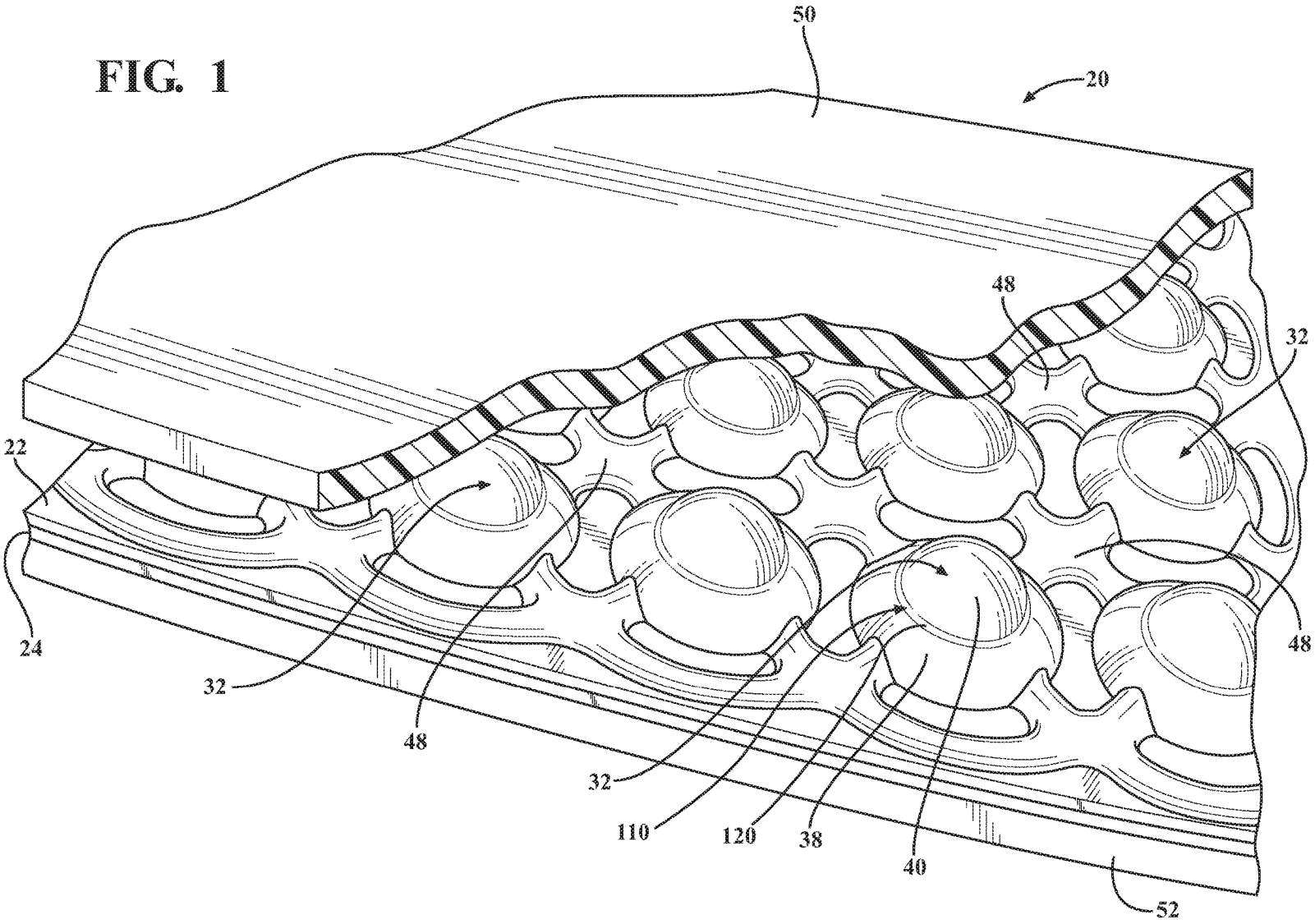
FIG. 1 is a schematic partially cut-away perspective view of a cushioning assembly.

A cushioning assembly includes a first bladder wall and a second bladder wall. The second bladder wall is disposed opposite the first bladder wall. At least one first dome is defined by the first bladder wall. The at least one first dome extends away from the second bladder wall. The at least one first dome and the second bladder wall cooperate together to define a fluid-filled cavity therebetween. The at least one first dome includes a first base portion having a first effective base radius, and a first cap portion having a first effective cap radius. The first effective cap radius is less than the first effective base radius.

In one embodiment of the cushioning assembly, the first base portion of the at least one first dome is disposed between the first cap portion of the at least one first dome and the second bladder wall.

In an embodiment of the cushioning assembly, both a circumference of the first base portion and a circumference of the first cap portion of the at least one first dome decrease with an increase in distance from the second bladder wall.

In an embodiment of the cushioning assembly, the first base portion of the at least one first dome defines a generally hemispherical segment.

In another embodiment of the cushioning assembly, the first cap portion of the at least one first dome defines a hemispherical cap.

In an embodiment of the cushioning assembly, the at least one first dome includes a plurality of first domes.

In an embodiment of the cushioning assembly, a plurality of passages are defined between the first bladder wall and the second bladder wall. Each of the plurality of passages interconnects one of the plurality of first domes with another one of the plurality of first domes.

In an embodiment of the cushioning assembly, a first load distribution structure is disposed adjacent the first cap portion of each of the plurality of first domes. The first load distribution structure is operable to transmit and distribute an applied load to the plurality of first domes.

In yet another embodiment of the cushioning assembly, a lattice structure includes at least one aperture having an effective aperture radius that is greater than the first effective cap radius of the first cap portion. The lattice structure is spaced apart from the second bladder wall, adjacent the first base portion of the at least one first dome. The first cap portion of the at least one first dome extends through the at least one aperture.

In an embodiment of the cushioning assembly, at least one second dome is defined by the second bladder wall, and disposed opposite the at least one first dome of the first bladder wall. The at least one second dome extends away from the first bladder wall. The at least one first dome of the first bladder wall and the at least one second dome of the second bladder wall cooperate together to define the fluid-filled cavity therebetween.

In an embodiment of the cushioning assembly, the at least one second dome includes a second base portion having a second effective base radius, and a second cap portion having a second effective cap radius. The second effective cap radius is less than the second effective base radius.

In an embodiment of the cushioning assembly, the second base portion of the at least one second dome is disposed between the second cap portion of the at least one second dome and the first bladder wall.

In another embodiment of the cushioning assembly, both a circumference of the second base portion and a circumference of the second cap portion of the at least one second dome decrease with an increase in distance from the first bladder wall.

In one embodiment of the cushioning assembly, the second base portion of the at least one second dome defines a generally hemispherical segment, and the second cap portion of the at least one second dome defines a hemispherical cap.

In an embodiment of the cushioning assembly, a second load distribution structure is disposed adjacent the second bladder wall. The second load distribution structure is operable to distribute an applied load over the second bladder wall.

In one embodiment of the cushioning assembly, the second load distribution structure is disposed adjacent the second cap portion of each of the plurality of second domes, and is operable to distribute the applied load to the plurality of second domes.

In an embodiment of the cushioning assembly, the at least one first dome includes a cylindrical portion disposed between the first base portion and the first cap portion. The cylindrical portion defines a circular cylinder.

In an embodiment of the cushioning assembly, each of the first bladder wall and the second bladder wall include a respective multi-layer polymeric sheet having alternating layers of a thermoplastic polyurethane and a gas barrier polymer.

A cushioning assembly for an article of footwear is also provided. The cushioning assembly includes a heel portion and a forefoot portion spaced from the heel portion along a longitudinal axis. The heel portion includes a first bladder wall, and a second bladder wall disposed opposite the first bladder wall. A plurality of first domes are defined by the first bladder wall. Each of the plurality of first domes extends away from the second bladder wall. A plurality of second domes are defined by the second bladder wall. The plurality of second domes extend away from the first bladder wall. Each of the plurality of second domes is disposed opposite one of the plurality of first domes to define respective pairs of domes, with each respective pair of domes cooperating together to define a fluid-filled cavity therebetween. Each of the plurality of the first domes include a first base portion having a first effective base radius, and a first cap portion having a first effective cap radius. The first effective cap radius is less than the first effective base radius. Each of the plurality of the second domes include a second base portion having a second effective base radius, and a second cap portion having a second effective cap radius. The second effective cap radius is less than the second effective base radius. A first load distribution structure is disposed adjacent the first cap portions of the plurality of first domes. The first load distribution structure is operable to distribute an applied load to the plurality of first domes. A second load distribution structure is disposed adjacent the second cap portions of the plurality of second domes. The second load distribution structure is operable to distribute an applied load to the plurality of second domes. The forefoot portion includes a third bladder wall, and a fourth bladder wall disposed opposite the third bladder wall. A plurality of third domes are defined by the third bladder wall, and extend away from the fourth bladder wall. The plurality of third domes and the fourth bladder wall cooperate together to define a plurality of fluid-filled cavities therebetween. Each of the plurality of third domes include a third base portion having a third effective base radius, and a third cap portion having a third effective cap radius. The third effective cap radius of each of the cap portions of each of the plurality of third domes is less than the third effective base radius of each of the base portions of each of the plurality of the third domes. A lattice structure includes a plurality of apertures having an effective aperture radius that is greater than the third effective cap radius of the cap portions of the plurality of third domes. The lattice structure is spaced apart from the fourth bladder wall, adjacent the third base portions of the plurality of third domes. One of the third cap portions of the plurality of third domes extends through one of the plurality of apertures in the lattice structure.

In an embodiment of the cushioning assembly for the article of footwear, the first base portion of each of the plurality of first domes, the second base portion of each of the plurality of second domes, and the third base portion of each of the plurality of third domes define a generally hemispherical segment, and the first cap portion of each of the plurality of first domes, the second cap portion of each of the plurality of second domes, and the third cap portion of each of the plurality of third domes define a hemispherical cap.

In one embodiment of the cushioning assembly for the article of footwear, each of the plurality of first domes includes a first cylindrical portion disposed between the first base portion and the first cap portion of each respective first dome.

In one embodiment of the cushioning assembly for the article of footwear, each of the plurality of second domes includes a second cylindrical portion disposed between the second base portion and the second cap portion of each respective second dome.

In one embodiment of the cushioning assembly for the article of footwear, each of the plurality of third domes includes a third cylindrical portion disposed between the third base portion and the third cap portion of each respective third dome.

In an embodiment of the cushioning assembly for the article of footwear, each of the first bladder wall, the second bladder wall, the third bladder wall, and the fourth bladder wall include a respective multi-layer polymeric sheet having alternating layers of a thermoplastic polyurethane and a gas barrier polymer.

The features and advantages of the present teachings are readily apparent from the following detailed description of modes for carrying out the teachings when taken in connection with the accompanying Figures.

The terms "A," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Those having ordinary skill in the art will recognize that terms such as "above," "below," "upward," "downward," "top," "bottom," etc., are used descriptively for the figures, and do not represent limitations on the scope of the disclosure, as defined by the appended claims. Furthermore, the teachings may be described herein in terms of functional and/or logical block components and/or various processing steps. It should be realized that such block components may be comprised of any number of hardware, software, and/or firmware components configured to perform the specified functions.

Figure 5:
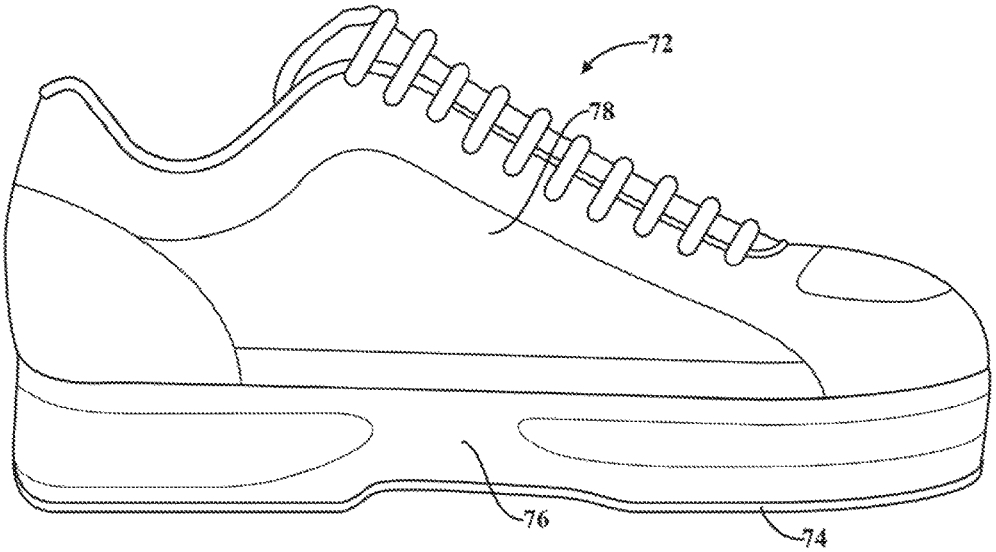
FIG. 5 is a schematic side view of a shoe.
Figure 6:
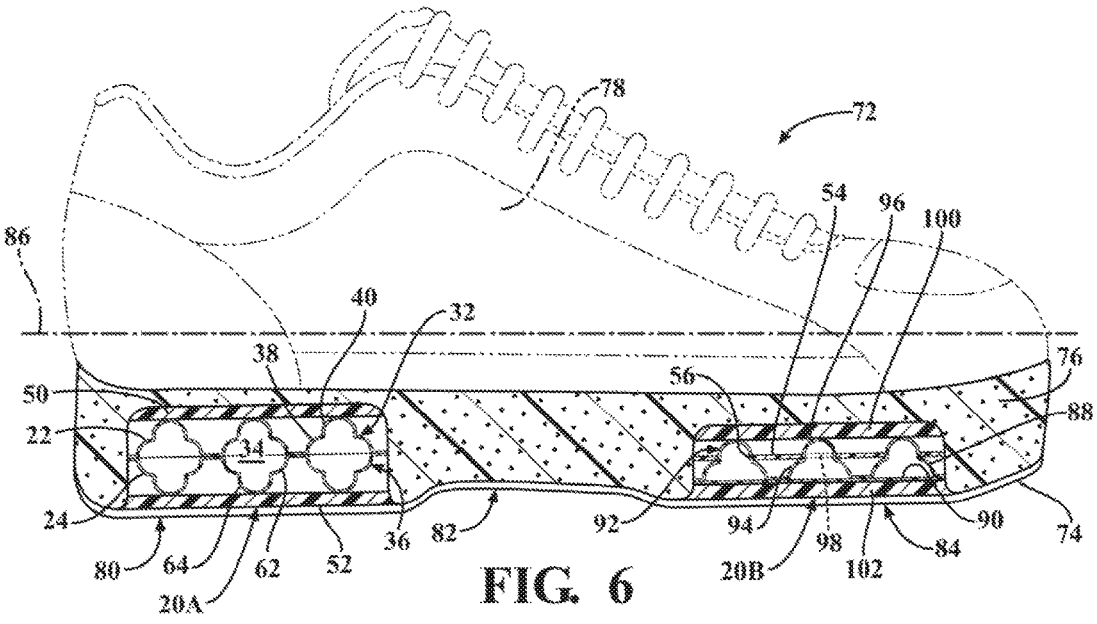
FIG. 6 is a schematic cross sectional view of a midsole of the shoe cut along a longitudinal axis of the shoe.

Referring to the Figures, wherein like numerals indicate like parts throughout the several views, a cushioning assembly is generally shown at 20. The cushioning assembly 20 includes features that are configured to provide a desired level of cushioning, stability, and responsiveness. The cushioning assembly 20 may be incorporated into any article, such as but not limited to an article of footwear 72, such as shown in FIGS. 5 and 6. In other embodiments, the cushioning assembly 20 may be incorporated into other types of footwear, such as but not limited to a dress shoe, a boot, a sandal, a slipper, or any other type and/or category of footwear. Alternatively, the cushioning assembly 20 may be incorporated into and used as a cushioning element in some other type of article, such as but not limited to a shoulder strap, a backpack, a shoulder pad, a glove, an elbow pad, a knee pad, a shin guard, other types of apparel or equipment, or a sports ball.

The cushioning assembly 20 may be configured in many different embodiments. Three exemplary embodiments are shown and described within FIGS. 1-4. However, it should be appreciated that the cushioning assembly 20 may be configured differently than the exemplary embodiments shown and described herein.

Referring to FIGS. 1-4, the cushioning assembly 20 includes a first bladder wall 22, and a second bladder wall 24. The second bladder wall 24 is disposed opposite the first bladder wall 22, to define opposing surfaces of the cushioning assembly 20. Preferably, each of the first bladder wall 22 and the second bladder wall 24 include and are manufactured from a respective multi-layer polymeric sheet 30 having alternating layers of a thermoplastic polyurethane and a gas barrier polymer.

Figure 7:
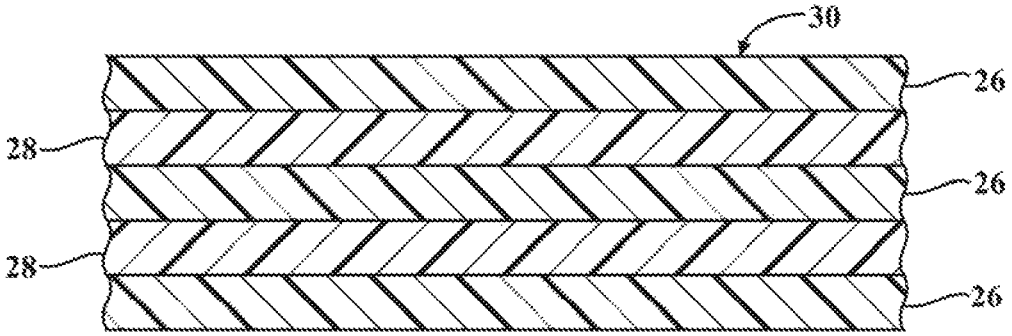
FIG. 7 is a schematic cross sectional view of a portion of a polymeric sheet used to construct wall portions of the cushioning assembly.

Referring to FIG. 7, the multi-layer polymeric sheets 30 used to form the first bladder wall 22 and the second bladder wall 24 are a laminate membrane formed from thin films having one or more first layers 26 that comprise thermoplastic polyurethane layers, and that alternate with one or more second layers 28, also referred to herein as barrier layers, gas barrier polymers, or gas barrier layers. The second layers 28 comprise a gas barrier composition, such as but not limited to a copolymer of ethylene and vinyl alcohol (EVOH), or other similar material, that is impermeable to a pressurized fluid contained therebetween, such as disclosed in U.S. Pat. No. 6,082,025 to Bonk et al., which is incorporated by reference in its entirety. The first layers 26 may be arranged to form an outer surface of the sheet. That is, the outermost first layer 26 shown in FIG. 7 may be the outer surface of the first bladder wall 22 or the second bladder wall 24. The first bladder wall 22 and the second bladder wall 24 may also be formed from a material that includes alternating layers of thermoplastic polyurethane and ethylene-vinyl alcohol copolymer, as disclosed in U.S. Pat. Nos. 5,713,141 and 5,952,065 to Mitchell et al. which are incorporated by reference in their entireties. Alternatively, the layers may include ethylene-vinyl alcohol copolymer, thermoplastic polyurethane, and a regrind material of the ethylene-vinyl alcohol copolymer and thermoplastic polyurethane. The first bladder wall 22 and the second bladder wall 24 may also be a flexible microlayer membrane that includes alternating layers of a gas barrier polymer material such as the second layers 28, and an elastomeric material such as the first layers 26, as disclosed in U.S. Pat. Nos. 6,082,025 and 6,127,026 to Bonk et al. which are incorporated by reference in their entireties. With such alternating layers, for example, the first bladder wall 22 and the second bladder wall 24 may have a gas transmission rate for nitrogen of less than 10 cubic centimeters per square meter per atmosphere per day, or of less than 1 cubic centimeter per square meter per atmosphere per day. Additional suitable materials for the first bladder wall 22 and the second bladder wall 24 are disclosed in U.S. Pat. Nos. 4,183,156 and 4,219,945 to Rudy which are incorporated by reference in their entireties. Further suitable materials for the first bladder wall 22 and the second bladder wall 24 include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340, 6,203,868, and 6,321,465 to Bonk et al. which are incorporated by reference in their entireties. In selecting materials for the first bladder wall 22 and the second bladder wall 24, engineering properties such as tensile strength, stretch properties, fatigue characteristics, dynamic modulus, and loss tangent can be considered. The thicknesses of the first layers 26 and the second layers 28 used to form the first bladder wall 22 and the second bladder wall 24 respectively can be selected to provide these characteristics. The various materials used for the first bladder wall 22 and the second bladder wall 24 discussed herein, may be substantially transparent. Additionally, in some embodiments, the various materials used for the first bladder wall 22 and the second bladder wall 24 may have a tinted color.

Referring to FIGS. 1 and 2, the cushioning assembly 20 includes at least one first dome 32 defined by the first bladder wall 22. As used herein, the term "dome" is defined as a vault having a generally circular plan and generally in the form of one or more approximate sphere portions, constructed to exert a substantially equal thrust in all directions. Preferably, and as shown, the at least one first dome 32 includes a plurality of first domes 32 defined by the first bladder wall 22. The first domes 32 extend away from the second bladder wall 24 to form an open interior region 121. The second bladder wall 24 extends across the open interior region 121 to enclose the open interior region 121. Each of the first domes 32 and the second bladder wall 24 cooperate together to define a fluid-filled cavity 34 therebetween. More specifically, the second bladder wall 24 extends across the open interior region 121 to define the fluid filled cavity 34 therebetween. As used herein, a "fluid" includes a gas, including air, an inert gas such as nitrogen, or another gas. Accordingly, "fluid-filled" includes "gas-filled."

As shown in FIGS. 1-3, the first bladder wall 22 defines the plurality of first domes 32, while the second bladder wall 24 is substantially planar. As shown in FIG. 4, the second bladder wall 24 is shown defining a plurality of second domes 36, with one of the second domes 36 disposed opposite one of the first domes 32.

Referring to FIG. 1, each of the first domes 32 is spaced from all of the remaining first domes 32. Preferably, the first domes 32 are arranged on the first bladder wall 22 in a consistent, geometric pattern or grid. However, it should be appreciated that the first domes 32 may be arranged in a random pattern.

Referring to FIGS. 1-3, each of the first domes 32 includes a first base portion 38 and a first cap portion 40. The first base portion 38 of each respective first dome 32 is disposed between the first cap portion 40 of that respective first dome 32, and the second bladder wall 24. Preferably, the first base portions 38 of the first domes 32 define a generally hemispherical segment. As used herein, the term "generally hemispherical segment" is defined as a surface defined by cutting a substantially sphere shaped object with a pair of parallel planes, and therefore may be considered a spherical frustrom. It should be appreciated that the generally hemispherical segment of the first base portions 38 may be defined by an object that is not perfectly spherical, but that deviates from a perfect sphere by some degree, and remains generally spherical in shape. The generally hemispherical segments of the first base portions 38 have or define a first effective base radius 42. The first effective base radius 42 is the radius of the generally spherical object that defines the generally hemispherical segment. As noted above, it should be appreciated that the generally spherical object that defines the generally hemispherical segment of the first base portions 38 may not be a perfect sphere, and as such, the radius of the generally spherical object may vary. Accordingly, the first effective base radius 42 of each of the generally hemispherical segments may be considered the average radius of the generally spherical object that defines the generally hemispherical segments of the first base portions 38.

Alternatively, the generally hemispherical segments of the first domes 32 may be described as a truncated hemispherical shape or a toroid. As used herein, a "toroid" is defined as an annular shape that is generated by revolving a plane geometrical object, such as a quarter circle, about an axis external to that geometric object, which is parallel to the plane of the geometric object, and does not intersect the geometric object.

Preferably, the first cap portions 40 of the first domes 32 define a generally hemispherical cap. As used herein, the term "hemispherical cap" is defined as a surface defined by a generally spherical object that lies above (or below) a given plane. It should be appreciated that the generally hemispherical cap of the first cap portions 40 may be defined by an object that is not perfectly spherical, but that deviates from a perfect sphere by some degree, and remains generally spherical in shape. The hemispherical caps of the first cap portions 40 have or define a first effective cap radius 44. The first effective cap radius 44 is the radius of the generally spherical object that defines the hemispherical cap. As noted above, it should be appreciated that the generally spherical object that defines the hemispherical cap of the first cap portions 40 may not be a perfect sphere, and as such, the radius of the generally spherical object may vary. Accordingly, the first effective cap radius 44 of each of the hemispherical caps may be considered the average radius of the generally spherical object that defines the hemispherical caps of the first cap portions 40.

Referring to FIGS. 2 and 4, each of the first domes 32 include a distinct intersection 110 separating the first base portion 38 and the first cap portion 40. The distinct intersection 110 forms a vertex 112 between the first base portion 38 and the first cap portion 40. A first reference line 114 extends through the distinct intersection 110, and tangent to the first base portion 38. A second reference line 116 is coplanar with the first reference line 114, and extends through the distinct intersection 110. The second reference line 116 is also tangent to the first cap portion 40. The first reference line 114 and the second reference line 116 form an angle 118 therebetween, which is less than one hundred eighty degrees (180°). The distinct intersection 110 forms a concave indent 120 in an outer surface 122 of the first domes 32. As shown in FIG. 1, the concave indent 120 encircles the first domes 32.

Both a circumference of the first base portion 38 and a circumference of the first cap portion 40 of each respective first dome 32 decrease with an increase in distance from the second bladder wall 24. However, the first effective cap radius 44 of each of the first cap portions 40 of each respective first dome 32 is less than the first effective base radius 42 of the first base portion 38 of that respective first dome 32. Furthermore, it should be appreciated that the generally spherical object that defines the generally hemispherical segment of the first base portions 38 is larger than the spherical object that defines the hemispherical caps of the first cap portions 40. For example, the first effective base radius 42 may be approximately twice the first effective cap radius 44, +/−a variance of approximately 20%. However, the relative ratio between the first effective base radius 42 and the first effective cap radius 44 may differ from the exemplary relationship provided herein.

Optionally, referring to FIG. 3, the first domes 32 may include a first cylindrical portion 46, which is disposed between the first base portion 38 and the first cap portion 40. Accordingly, the first cylindrical portion 46 spaces the first cap portion 40 from the first base portion 38. The first cylindrical portion 46 defines a generally circular cylinder. The effective radius of the first cylindrical portion 46 is substantially equal to a smaller of the two circular bases of the generally hemispherical segment defined by the first base portion 38, and a circular base of the hemispherical cap defined by the first cap portion 40, of each respective first dome 32.

Referring to FIG. 1, the cushioning assembly 20 may include a plurality of passages 48 that are defined between the first bladder wall 22 and the second bladder wall 24. Each of the passages 48 interconnects one of the first domes 32, with another one of the first domes 32, in fluid communication. Accordingly, each of the passages 48 interconnects one of the fluid-filled cavities with another one of the fluid-filled cavities, such that all of the fluid-filled cavities are interconnected in fluid communication. The passages 48 may be used during manufacture to simplify the introduction of fluid into each of the fluid-filled cavities, after which each of the passages 48 may be sealed off and/or disconnected from the fluid-filled cavities connected thereto. Alternatively, the passages 48 may remain open and in fluid communication with the fluid-filled cavities to allow the fluid, e.g, gas, to flow between the fluid-filled cavities during use of the cushioning assembly 20.

The cushioning assembly 20 may further include a first load distribution structure 50 and/or a second load distribution structure 52. The first load distribution structure 50 may be disposed adjacent the first bladder wall 22, and the second load distribution structure 52 may be disposed adjacent the second bladder wall 24. As shown in the Figures, the first load distribution structure 50 is disposed adjacent the first cap portions 40 of the first domes 32. The first load distribution structure 50 is operable to transmit and distribute an applied load to the first bladder wall 22. More specifically, the first load distribution structure 50 is operable to distribute the applied load to the plurality of first domes 32, and more specifically to the cap portions of the first domes 32. The second load distribution structure 52 is operable to transmit and distribute an applied load to the second bladder wall 24. The first load distribution structure 50 may include and be manufactured from a generally rigid material, such as a plastic or rigid foam, that is capable of transferring the applied load to the cap portions of the first domes 32, without substantially deforming around the cap portions of the first domes 32. The second load distribution structure 52 may include and be manufactured from the same materials suitable for the first load distribution structure 50.

Referring to FIG. 3, the cushioning assembly 20 may include a lattice structure 54. The lattice structure 54 includes at least one aperture 56. More specifically, the lattice structure 54 includes one aperture 56 for every first dome 32. Each of the apertures 56 of the lattice structure 54 defines a generally circular opening having an effective aperture radius 58 that is greater than the first effective cap radius 44 of the first cap portion 40, and less than the first effective base radius 42 of the first base portion 38. The lattice structure 54 is spaced apart from the second bladder wall 24, adjacent the smaller of the two annular bases of the generally hemispherical segment of the first base portions 38 of the first domes 32. The first cap portions 40 of the first domes 32 extend through a respective aperture 56. It should be appreciated that the lattice structure 54 may be used independently of or in combination with the first load distribution structure 50. The lattice structure 54 may include and be manufactured from a generally rigid material, such as but not limited to a plastic or nylon material.

As noted above, and with reference to FIG. 4, the cushioning assembly 20 may include at least one second dome 36 defined by the second bladder wall 24. The at least one second dome 36 is disposed opposite one of the first domes 32 defined by the first bladder wall 22. Preferably, the second bladder wall 24 defines one second dome 36 opposite each of the first domes 32. The second domes 36 extend away from the first bladder wall 22. One of the first domes 32 of the first bladder wall 22 and one of the second domes 36 of the second bladder wall 24 cooperate together to define one fluid-filled cavity 34 therebetween. Preferably, the first domes 32 and the second domes 36 are mirror images of each other across a reference plane 60 defined by the contact joint/interface between the first bladder wall 22 and the second bladder wall 24. However, it should be appreciated that the size and/or shape of the first domes 32 and the second domes 36 may differ from each other.

Referring to FIG. 4, each of the second domes 36 includes a second base portion 62 and a second cap portion 64. The second base portion 62 of each respective second dome 36 is disposed between the second cap portion 64 of that respective second dome 36, and the first bladder wall 22. Preferably, the second base portions 62 of the second domes 36 define a generally hemispherical segment, as defined above with respect to the first base portions 38. The generally hemispherical segments of the second base portions 62 have or define a second effective base radius 66. The second effective base radius 66 is the radius of the generally spherical object that defines the generally hemispherical segment. It should be appreciated that the generally spherical object that defines the generally hemispherical segment of the second base portions 62 may not be a perfect sphere, and as such, the radius of the generally spherical object may vary. Accordingly, the second effective base radius 66 of each of the generally hemispherical segments may be considered the average radius of the generally spherical object that defines the generally hemispherical segments of the second base portions 62. Alternatively, the generally hemispherical segments of the second domes 36 may be described as a toroid, as described above with respect to the first base portions 38.

Preferably, the second cap portions 64 of the second domes 36 define a generally hemispherical cap as described above with respect to the first cap portions 40. It should be appreciated that the generally hemispherical cap of the second cap portions 64 may be defined by an object that is not perfectly spherical, but that deviates from a perfect sphere by some degree, and remains generally spherical in shape. The hemispherical caps of the second cap portions 64 have or define a second effective cap radius 68. The second effective cap radius 68 is the radius of the generally spherical object that defines the hemispherical cap. It should be appreciated that the generally spherical object that defines the hemispherical cap of the second cap portions 64 may not be a perfect sphere, and as such, the radius of the generally spherical object may vary. Accordingly, the second effective cap radius 68 of each of the hemispherical caps may be considered the average radius of the generally spherical object that defines the hemispherical caps of the second cap portions 64.

Both a circumference of the second base portion 62 and a circumference of the second cap portion 64 of each respective second dome 36 decrease with an increase in distance from the first bladder wall 22. However, the second effective cap radius 68 of each of the second cap portions 64 of each respective second dome 36 is less than the second effective base radius 66 of the second base portion 62 of that respective second dome 36. Furthermore, it should be appreciated that the generally spherical object that defines the generally hemispherical segment of the second base portions 62 is larger than the spherical object that defines the hemispherical caps of the second cap portions 64. For example, the second effective base radius 66 may be approximately twice the second effective cap radius 68, +/−a variance of approximately 20%. However, the relative ratio between the second effective base radius 66 and the second effective cap radius 68 may differ from the exemplary relationship provided herein.

Optionally, referring to FIG. 4, the second domes 36 may include a second cylindrical portion 70, which is disposed between the second base portion 62 and the second cap portion 64. Accordingly, the second cylindrical portion 70 spaces the second cap portion 64 from the second base portion 62. The second cylindrical portion 70 defines a generally circular cylinder having an effective radius. The effective radius of the second cylindrical portion 70 is substantially equal to a smaller of the two circular bases of the generally hemispherical segment defined by the second base portion 62, and a circular base of the hemispherical cap defined by the second cap portion 64, of each respective second dome 36.

As noted above, the cushioning assembly 20 may include the second load distribution structure 52 disposed adjacent the second bladder wall 24. As shown in FIG. 4, the second load distribution structure 52 is disposed adjacent the second cap portions 64 of the second domes 36. The second load distribution structure 52 is operable to transmit and distribute the applied load to the second bladder wall 24. More specifically, the second load distribution structure 52 is operable to distribute the applied load to the second domes 36, and more specifically to the second cap portions 64 of the second domes 36.

The cushioning assembly 20 is described above with reference to three different embodiments. A first embodiment of the cushioning assembly 20 is shown in FIGS. 1-2, in which the first bladder wall 22 defines the first domes 32, and the second bladder wall 24 is substantially planar. The embodiment of the cushioning assembly 20 shown in FIGS. 1-2 includes the first load distribution structure 50 disposed atop the first cap portions 40 of the first domes 32, and the second load distribution structure 52 disposed adjacent the generally planar second bladder wall 24. The second embodiment of the cushioning assembly 20 shown in FIG. 3 is similar to the first embodiment shown in FIGS. 1 and 2, but further includes the lattice structure 54, disposed between the first load distribution structure 50 and the first bladder wall 22. The third embodiment of the cushioning assembly 20 shown in FIG. 4 includes the second bladder wall 24 defining the second domes 36 disposed opposite the first domes 32 of the first bladder wall 22, with the second load distribution structure 52 disposed adjacent the second cap portions 64 of the second domes 36. Different embodiments of the cushioning assembly 20 may be used independently of or in combination with other embodiments of the cushioning assembly 20 to provide the desired cushioning, support, performance, etc., for a specific article.

For example, referring to FIGS. 5 and 6, an article of footwear is generally shown at 72. Referring to FIG. 5, the article of footwear 72 includes an outsole 74, a midsole 76, an insole, and an upper 78. The cushioning assembly 20 may generally be considered attached to and/or part of the midsole 76 of the article of footwear 72. Specifically, as shown in FIG. 6, the midsole 76 includes a first cushioning assembly 20A, and a second cushioning assembly 20B. The midsole 76 includes a heel portion 80, a midfoot portion 82, and a forefoot portion 84. The first cushioning assembly 20A is incorporated into the heel portion 80, and the second cushioning assembly 20B is incorporated into the forefoot portion 84. The forefoot portion 84 is spaced from the heel portion 80 along a longitudinal axis 86 of the article of footwear 72, with the midfoot portion 82 disposed between the heel portion 80 and the forefoot portion 84. The forefoot portion 84 is generally the forward-most third of the article of footwear 72 when worn on a foot, the midfoot portion 82 is generally the middle third, and the heel portion 80 is generally the rearmost third.

The heel portion 80 generally includes portions of the article of footwear 72 and the cushioning assembly 20 corresponding with rear portions of a human foot of a size corresponding with the article of footwear 72, including the calcaneus bone. The forefoot portion 84 generally includes portions of the article of footwear 72 and the cushioning assembly 20 corresponding with the toes and the joints connecting the metatarsals with the phalanges of the human foot of the size corresponding with the article of footwear 72. The midfoot portion 82 generally includes portions of the article of footwear 72 and the cushioning assembly 20 corresponding with an arch area of the human foot of the size corresponding with the article of footwear 72.

Referring to FIG. 6, the cushioning assembly 20B is configured as shown in FIG. 3, whereas the cushioning assembly 20A is configured as shown in FIG. 4. The midfoot portion 82 is generally formed from a foam material connecting the heel portion 80 and the forefoot portion 84.

Referring to the midsole 76 shown in FIG. 6, the cushioning assembly 20A of the heel portion 80 includes the first bladder wall 22, and the second bladder wall 24. The second bladder wall 24 is disposed opposite the first bladder wall 22, to define opposing surfaces of the cushioning assembly 20. Preferably, each of the first bladder wall 22 and the second bladder wall 24 include and are manufactured from a respective multi-layer polymeric sheet 30 having alternating layers of a thermoplastic polyurethane and a gas barrier polymer, as described above.

As shown in FIG. 6, the cushioning assembly 20A includes a plurality of first domes 32 defined by the first bladder wall 22, disposed opposite a plurality of second domes 36 defined by the second bladder wall 24. The first domes 32 extend away from the second bladder wall 24, and the second domes 36 extend away from the first bladder wall 22. Each of the first domes 32 of the first bladder wall 22 is disposed opposite one of the second domes 36 of the second bladder wall 24 to define a respective pair of opposing domes that cooperate together to define the fluid-filled cavity 34 therebetween. All of the plurality of first domes 32 and the plurality of second domes 36 may each include an identical size and/or shape. Alternatively, each of the plurality of first domes 32 may vary in size and/or shape relative to the other first domes 32, and to the second domes 36. Similarly, each of the plurality of second domes 36 may vary in size and/or shape from the other second domes 36, and to the first domes 32.

Each of the first domes 32 includes the first base portion 38 and the first cap portion 40. The first base portion 38 of each respective first dome 32 is disposed between the first cap portion 40 of that respective first dome 32, and the second bladder wall 24. Preferably, the first base portions 38 of the first domes 32 define a generally hemispherical segment as described above with reference to the embodiments of the cushioning assembly 20 shown in FIGS. 1 through 4. The generally hemispherical segments of the first base portions 38 have or define the first effective base radius 42. The first cap portions 40 of the first domes 32 define a generally hemispherical cap as described above. The hemispherical caps of the first cap portions 40 have or define the first effective cap radius 44. The first effective cap radius 44 is the radius of the generally spherical object that defines the hemispherical cap.

Optionally, the first domes 32 may include the first cylindrical portion 46, which is disposed between the first base portion 38 and the first cap portion 40. Accordingly, the first cylindrical portion 46 spaces the first cap portion 40 from the first base portion 38. The first cylindrical portion 46 defines a generally circular cylinder having an effective radius. The effective radius of the cylindrical portion is substantially equal to a smaller of the two circular bases of the generally hemispherical segment defined by the first base portion 38, and a circular base of the hemispherical cap defined by the first cap portion 40, of each respective first dome 32. A height of each respective first cylindrical portion 46 of each of the first domes 32 may vary from the height of the other first cylindrical portions 46 of the other first domes 32.

The first load distribution structure 50 is disposed adjacent the first cap portions 40 of the first domes 32. The first load distribution structure 50 is operable to transmit and distribute an applied load to the first bladder wall 22. More specifically, the first load distribution structure 50 is operable to distribute the applied load to the plurality of first domes 32, and more specifically to the cap portions of the first domes 32.

Each of the second domes 36 includes a second base portion 62 and a second cap portion 64, as described above with reference to the embodiment of the cushioning assembly 20 shown in FIG. 4. The second base portion 62 of each respective second dome 36 is disposed between the second cap portion 64 of that respective second dome 36, and the first bladder wall 22. Preferably, the second base portions 62 of the second domes 36 define a generally hemispherical segment, as defined above. The generally hemispherical segments of the second base portions 62 have or define a second effective base radius 66. The second cap portions 64 of the second domes 36 define a generally hemispherical cap as described above. The hemispherical caps of the second cap portions 64 have or define a second effective cap radius 68. The second effective cap radius 68 is the radius of the generally spherical object that defines the hemispherical cap. Both a circumference of the second base portion 62 and a circumference of the second cap portion 64 of each respective second dome 36 decrease with an increase in distance from the first bladder wall 22.

Optionally, each of the second domes 36 may include a second cylindrical portion 70, as described above with reference to the embodiment of the cushioning assembly 20 shown in FIG. 4, which is disposed between the second base portion 62 and the second cap portion 64 of a respective second dome 36. Accordingly, the second cylindrical portion 70 spaces the second cap portion 64 from the second base portion 62 of its respective second dome 36. A height of each respective second cylindrical portion 70 of each of the second domes 36 may vary from the height of the other second cylindrical portions 70 of the other second domes 36.

As shown in FIG. 6, the cushioning assembly 20A of the heel portion 80 includes the second load distribution structure 52 disposed adjacent the second cap portions 64 of the second domes 36. The second load distribution structure 52 is operable to transmit and distribute the applied load to the second bladder wall 24. More specifically, the second load distribution structure 52 is operable to distribute the applied load to the second domes 36, and more specifically to the second cap portions 64 of the second domes 36.

Referring to FIG. 6, the cushioning assembly 20B of the forefoot portion 84 includes a third bladder wall 88, and a fourth bladder wall 90. It should be appreciated that the third bladder wall 88 is identical to the first bladder wall 22 described above with reference to FIGS. 1 through 4, and is only renamed the third bladder wall 88 for clarity to distinguish it from the first bladder wall 22 described above in the heel portion 80 of the cushioning assembly 20 of FIG. 6. Similarly, the fourth bladder wall 90 is identical to the second bladder wall 24 described above with reference to FIGS. 1 through 4, and is only renamed the fourth bladder wall 90 for clarity to distinguish it from the second bladder wall 24 described above in the heel portion 80 of the cushioning assembly 20 of FIG. 6. The cushioning assembly 20B of the forefoot portion 84 shown in FIG. 6 is configured similarly to the embodiment of the cushioning assembly 20 shown in FIG. 3, and described above.

The fourth bladder wall 90 is disposed opposite the third bladder wall 88, to define opposing surfaces of the cushioning assembly 20. Preferably, each of the third bladder wall 88 and the fourth bladder wall 90 include and are manufactured from a respective multi-layer polymeric sheet 30 having alternating layers of a thermoplastic polyurethane and a gas barrier polymer, as described above. Furthermore, the third bladder wall 88 may be formed from the same sheet as the first bladder wall 22, and the fourth bladder wall 90 may be formed from the same sheet as the second bladder wall 24. Alternatively, the third bladder wall 88 may be formed from a separate sheet relative to the first bladder wall 22, and the fourth bladder wall 90 may be formed from a separate sheet relative to the second bladder wall 24.

As shown in FIG. 6, the cushioning assembly 20B includes a plurality of third domes 92 defined by the third bladder wall 88, disposed opposite the substantially planar fourth bladder wall 90. The third domes 92 extend away from the fourth bladder wall 90. Each of the third domes 92 of the third bladder wall 88 cooperate with the fourth bladder wall 90 to define a fluid-filled cavity 34 therebetween. It should be appreciated that the third domes 92 are identical to the first domes 32 described above with reference to FIGS. 1 through 3, and are only renamed the third domes 92 for clarity to distinguish them from the first domes 32 described above in the cushioning assembly 20A of the heel portion 90 shown in FIG. 6. Similarly, it should be appreciated that the third base portions 94 and the third cap portions 96 of the third domes 92 are identical to the first base portions 38 and the first cap portions 40 of the first domes 32 described above with reference to FIGS. 1 through 3, and are only renamed the third base portions 94 and the third cap portions 96 for clarity to distinguish them from the first base portions 38 and the first cap portions 40 described above in the cushioning assembly 20A shown in FIG. 6.

Each of the third domes 92 includes a third base portion 94 and a third cap portion 96. The third base portion 94 of each respective third dome 92 is disposed between the third cap portion 96 of that respective third dome 92, and the fourth bladder wall 90. Preferably, the third base portions 94 of the third domes 92 define a generally hemispherical segment as described above with respect to the first base portions 38 and the second base portions 62. The generally hemispherical segments of the third base portions 94 have or define a third effective base radius. The third cap portions 96 of the third domes 92 define a generally hemispherical cap as described above with respect to the first base portions 38 and the second base portions 62. The hemispherical caps of the third cap portions 96 have or define a third effective cap radius. The third effective cap radius is the radius of the generally spherical object that defines the hemispherical cap.

Optionally, the third domes 92 may include a third cylindrical portion 98, which is disposed between the third base portion 94 and the third cap portion 96. Accordingly, the third cylindrical portion 98 spaces the third cap portion 96 from the third base portion 94. The third cylindrical portion 98 defines a generally circular cylinder having an effective radius. The effective radius of the third cylindrical portion 98 is substantially equal to a smaller of the two circular bases of the generally hemispherical segment, and a circular base of the hemispherical cap, of each respective third dome 92. A height of each respective third cylindrical portion 98 of each of the third domes 92 may vary from the height of the other third cylindrical portions 98 of the other third domes 92.

As shown, a third load distribution structure 100 is disposed adjacent the third cap portions 96 of the third domes 92. It should be appreciated that the third load distribution structure 100 is identical to the first load distribution structure 50 described above with reference to FIGS. 1 through 3, and is only renamed the third load distribution structure 100 for clarity to distinguish it from the first load distribution structure 50 described above in the cushioning assembly 20A of the heel portion 80 shown in FIG. 6. It should be appreciated that the first load distribution structure 50 and the third load distribution structure 100 may include a single element disposed adjacent the first domes 32 of the heel portion 80 and the third domes 92 of the forefoot portion 84, or may include two separate elements, with the first load distribution structure 50 disposed adjacent the first domes 32 of the heel portion 80, and the third load distribution structure 100 disposed adjacent the third domes 92 of the forefoot portion 84. The third load distribution structure 100 is operable to transmit and distribute the applied load to the third bladder wall 88. More specifically, the third load distribution structure 100 is operable to distribute the applied load to the plurality of third domes 92, and more specifically to the cap portions of the third domes 92.

As shown in FIG. 6, a fourth load distribution structure 102 is disposed adjacent fourth bladder wall 90. The fourth load distribution structure 102 is operable to transmit and distribute the applied load to the fourth bladder wall 90. It should be appreciated that the fourth load distribution structure 102 is identical to the second load distribution structure 52 described above with reference to FIGS. 1 through 3, and is only renamed the fourth load distribution structure 102 for clarity to distinguish it from the second load distribution structure 52 described above in the cushioning assembly 20A of the heel portion 80 shown in FIG. 6. It should be appreciated that the second load distribution structure 52 and the fourth load distribution structure 102 may include a single element disposed adjacent the second domes 36 of the heel portion 80 and the fourth bladder wall 90 of the forefoot portion 84, or may include two separate elements, with the second load distribution structure 52 disposed adjacent the second domes 36 of the heel portion 80, and the fourth load distribution structure 102 disposed adjacent the fourth bladder wall 90 of the forefoot portion 84.

As shown in FIG. 6, the forefoot portion 84 of the cushioning assembly 20 includes the lattice structure 54 that is shown in the embodiment of the cushioning assembly 20 shown in FIG. 3. The lattice structure 54 includes one aperture 56 for every third dome 92. Each of the apertures 56 of the lattice structure 54 defines a generally circular opening having an effective aperture radius 58 that is greater than the third effective cap radius of the third cap portion 96, and less than the third effective base radius of the third base portion 94. The lattice structure 54 is spaced apart from the fourth bladder wall 90, adjacent the smaller of the two annular bases of the generally hemispherical segment of the third base portions 94 of the third domes 92. The third cap portions 96 of the third domes 92 extend through a respective aperture 56.

Figure 8:
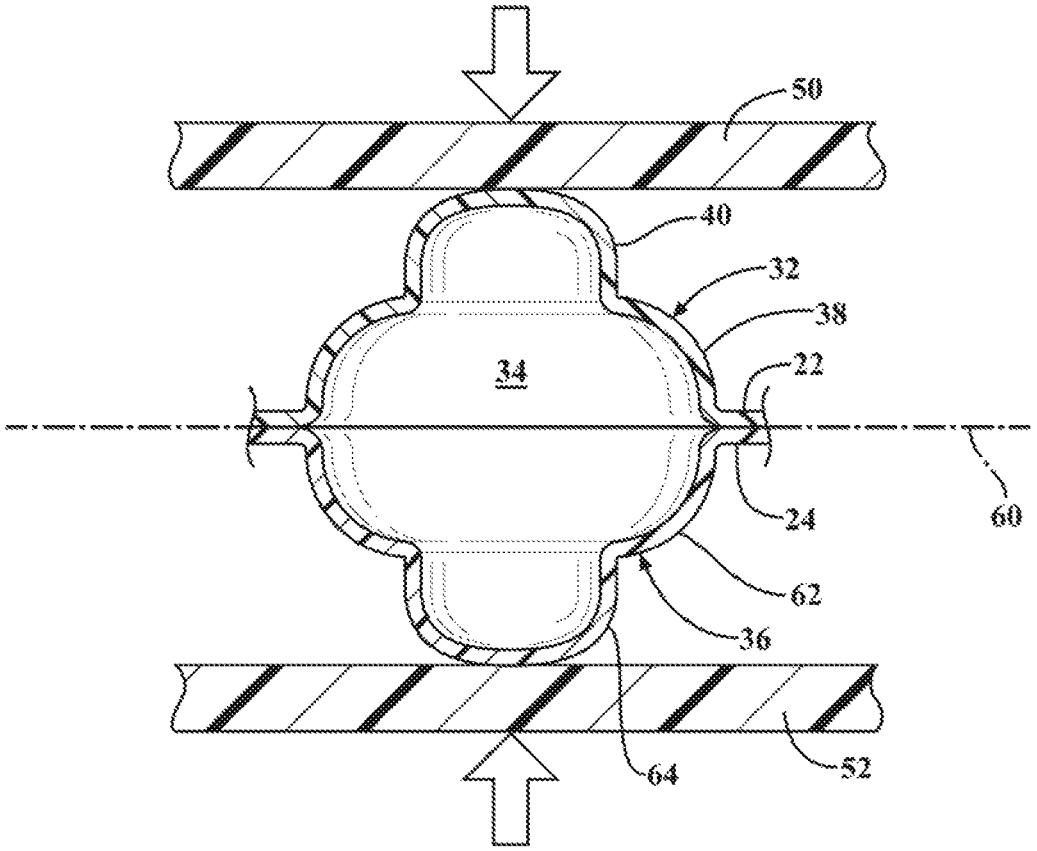
FIG. 8 is a schematic fragmentary cross sectional view of the cushioning assembly showing a first stage of cushioning.
Figure 9:
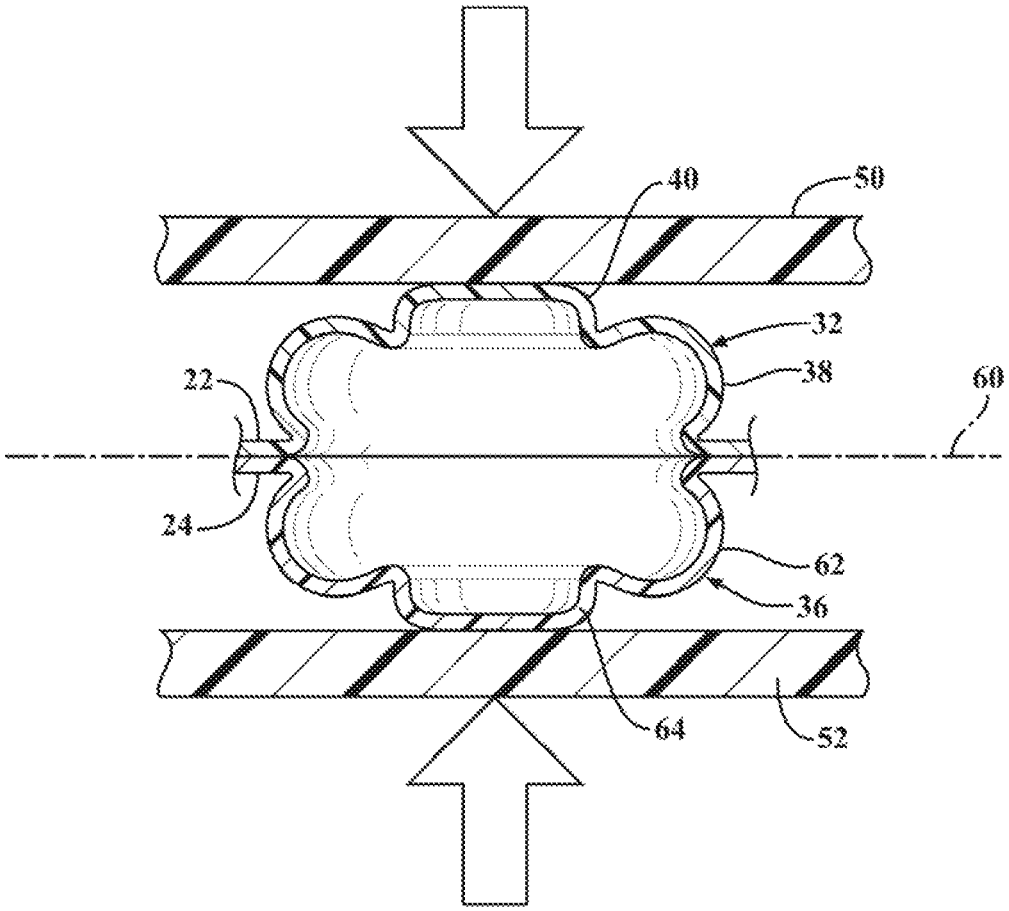
FIG. 9 is a schematic fragmentary cross sectional view of the cushioning assembly showing a second state of cushioning.

The cushioning assemblies 20A, 20B of the midsole 76 shown in FIG. 6 operate to cushion or dampen a force imparted to the wearer of the shoe during use. In response to the wearer stepping down, a force is applied to the cushioning assembly 20. Each of the cap portions, i.e., the first cap portions 40, the second cap portions 64 and/or the third cap portions 96, may deflect inward in response to this force. Initially, such as shown in FIG. 8, the cap portions deflect inward, and the base portions do not deflect inward. However, upon the force reaching a pre-defined level, the base portions, i.e., the first base portions 38, the second base portions 62, and/or the third base portions 94 will also deflect inward, such as shown in FIG. 9. Accordingly, the cushioning assemblies 20A, 20B provide two distinct stages of energy absorption. A first stage is provided by the cap portions, and a second stage is provided by the base portions of the respective domes. The inward deflection of the cap portions and the base portions absorb energy, thereby reducing the energy transmitted to the wearer of the shoe, and providing a cushioning effect to the wearer.

The detailed description and the Figures are supportive and descriptive of the present teachings, but the scope of the present teachings is defined solely by the appended claims. While several modes for carrying out the many aspects of the present teachings have been described in detail, those familiar with the art to which these teachings relate will recognize various alternative aspects for practicing the present teachings that are within the scope of the appended claims.

The invention claimed is:

1. A cushioning assembly for a shoe, the cushioning assembly comprising:

a midsole;

a first bladder wall positioned in the midsole;

a second bladder wall positioned in the midsole and disposed opposite the first bladder wall; and at least one first dome defined by the first bladder wall and extending away from the second bladder wall, wherein the at least one first dome forms an open interior region, and wherein the second bladder wall extends across the open interior region of the at least one first dome to enclose the open interior region and define a fluid-filled cavity between the at least one first dome of the first bladder wall and the second bladder wall;

wherein the at least one first dome includes a first base portion having a first effective base radius, and a first cap portion extending outward from the first base portion further from the second bladder wall than the first effective base radius, the first cap portion having a first effective cap radius, with the first effective cap radius being less than the first effective base radius; wherein both a circumference of the first base portion and a circumference of the first cap portion of the at least one first dome decrease with an increase in distance from the second bladder wall;

wherein the at least one first dome includes a distinct intersection separating the first base portion and the first cap portion, the fluid-filled cavity filling the first base portion and extending past the first effective base radius to fill the first cap portion; and a first load distribution structure positioned in the midsole and disposed in contact with the first cap portion of the at least one first dome, wherein the first load distribution structure is operable to transmit and distribute an applied load to the at least one first dome.

2. The cushioning assembly set forth in claim 1 wherein the first base portion of the at least one first dome is disposed between the first cap portion of the at least one first dome and the second bladder wall.

3. The cushioning assembly set forth in claim 1, wherein the first base portion of the at least one first dome defines a generally hemispherical segment.

4. The cushioning assembly set forth in claim 1, wherein the first cap portion of the at least one first dome defines a hemispherical cap.

5. The cushioning assembly set forth in claim 1, wherein the at least one first dome includes a plurality of first domes.

6. The cushioning assembly set forth in claim 5, further comprising a plurality of passages defined between the first bladder wall and the second bladder wall, with each of the plurality of passages interconnecting one of the plurality of first domes with another one of the plurality of first domes.

7. The cushioning assembly set forth in claim 5, further comprising a lattice structure including at least one aperture configured as a through hole extending entirely through the lattice structure and having an effective aperture radius greater than the first effective cap radius of the first cap portion, wherein the lattice structure is spaced apart from the second bladder wall, adjacent the first base portion of the at least one first dome, with the first cap portion extending through the at least one aperture.

8. The cushioning assembly set forth in claim 1, further comprising at least one second dome defined by the second bladder wall and disposed opposite the at least one first dome, wherein the at least one second dome extends away from the first bladder wall, the at least one first dome of the first bladder wall and the at least one second dome of the second bladder wall cooperating together to define the fluid-filled cavity therebetween.

9. The cushioning assembly set forth in claim 8, wherein the at least one second dome includes a second base portion having a second effective base radius, and a second cap portion having a second effective cap radius, with the second effective cap radius being less than the second effective base radius.

10. The cushioning assembly set forth in claim 9, wherein the second base portion of the at least one second dome is disposed between the second cap portion of the at least one second dome and the first bladder wall.

11. The cushioning assembly set forth in claim 9, wherein both a circumference of the second base portion and a circumference of the second cap portion of the at least one second dome decrease with an increase in distance from the first bladder wall.

12. The cushioning assembly set forth in claim 9, wherein the second base portion of the at least one second dome defines a generally hemispherical segment.

13. The cushioning assembly set forth in claim 9, wherein the second cap portion of the at least one second dome defines a hemispherical cap.

14. The cushioning assembly set forth in claim 9, further comprising a second load distribution structure disposed adjacent the second bladder wall, and operable to distribute an applied load across the second bladder wall.

15. The cushioning assembly set forth in claim 14 wherein the at least one second dome includes a plurality of second domes, and wherein the second load distribution structure is disposed adjacent the second cap portion of each of the plurality of second domes, and is operable to distribute the applied load to two or more of the plurality of second domes.

16. The cushioning assembly set forth in claim 1, wherein:

the at least one first dome includes a cylindrical portion disposed between the first base portion and the first cap portion.

17. The cushioning assembly set forth in claim 1, wherein each of the first bladder wall and the second bladder wall include a respective multi-layer polymeric sheet having alternating layers of a thermoplastic polyurethane and a gas barrier polymer.

18. A cushioning assembly for an article of footwear, the cushioning assembly comprising:

a heel portion and a forefoot portion spaced from the heel portion along a longitudinal axis;

the heel portion including:

a first bladder wall;

a second bladder wall disposed opposite the first bladder wall;

a plurality of first domes defined by the first bladder wall, with each of the plurality of first domes extending away from the second bladder wall; and a plurality of second domes defined by the second bladder wall, the plurality of second domes extending away from the first bladder wall, with each of the plurality of second domes disposed opposite one of the plurality of first domes to define respective pairs of domes, with each respective pair of domes cooperating together to define a fluid-filled cavity there between;

each of the plurality of the first domes including a first base portion having a first effective base radius, and a first cap portion extending outward from the first base portion further from the second bladder wall than the first effective base radius, the first cap portion having a first effective cap radius, with the first effective cap radius being less than the first effective base radius; wherein both a circumference of the first base portion and a circumference of the first cap portion decrease with an increase in distance from the second bladder wall;

wherein each of the plurality of first domes includes a respective distinct intersection separating the first base portion and the first cap portion, and forming a vertex therebetween, the fluid-filled cavity filling the first base portion and extending past the first effective base radius to fill the first cap portion;

each of the plurality of the second domes including a second base portion having a second effective base radius, and a second cap portion having a second effective cap radius, with the second effective cap radius being less than the second effective base radius;

wherein each of the plurality of second domes includes a respective distinct intersection separating the second base portion and the second cap portion, and forming a vertex therebetween;

a first load distribution structure disposed adjacent the first cap portions of the plurality of first domes, and operable to distribute an applied load to two or more of the plurality of first domes;

a second load distribution structure disposed adjacent the second cap portions of the plurality of second domes, and operable to distribute an applied load to two or more of the plurality of second domes;

the forefoot portion including:

a third bladder wall;

a fourth bladder wall disposed opposite the third bladder wall;

a plurality of third domes defined by the third bladder wall and extending away from the fourth bladder wall, the plurality of third domes and the fourth bladder wall cooperating together to define a plurality of fluid-filled cavities therebetween;

each of the plurality of third domes including a third base portion having a third effective base radius, and a third cap portion having a third effective cap radius, with the third effective cap radius of each of the cap portions of each of the plurality of third domes being less than the third effective base radius of each of the base portions of each of the plurality of the third domes;

wherein each of the plurality of third domes includes a respective distinct intersection separating the third base portion and the third cap portion, and forming a vertex therebetween; and a lattice structure including a plurality of apertures having an effective aperture radius greater than the third effective cap radius of the cap portions of the plurality of third domes, wherein the lattice structure is spaced apart from the fourth bladder wall, adjacent the third base portions of the plurality of third domes, with at least one of the third cap portions of the plurality of third domes extending through at least one of the plurality of apertures in the lattice structure.

19. The cushioning assembly set forth in claim 18 wherein the first base portion of each of the plurality of first domes, the second base portion of each of the plurality of second domes, and the third base portion of each of the plurality of third domes defines a generally hemispherical segment, and wherein the first cap portion of each of the plurality of first domes, the second cap portion of each of the plurality of second domes, and the third cap portion of each of the plurality of third domes defines a hemispherical cap.

20. The cushioning assembly set forth in claim 1, wherein the distinct intersection forms a vertex between the first base portion and the first cap portion.

21. The cushioning assembly set forth in claim 1, wherein a first reference line extending through the distinct intersection and tangent to the first base portion, and a second reference line coplanar with the first reference line, extending through the distinct intersection, and tangent to the first cap portion, forms an angle therebetween of less than one hundred eighty degrees (180°).

22. The cushioning assembly set forth in claim 1, wherein the distinct intersection forms a concave indent in an outer surface of the at least one first dome.

23. The cushioning assembly set forth in claim 22, wherein the concave indent encircles the at least one first dome.

24. The cushioning assembly set forth in claim 5, wherein the first load distribution structure includes a planar structure operable to transmit and distribute the applied load to two or more of the plurality of first domes without deforming around the plurality of first domes so that the plurality of first domes may deflect in response to the applied load.

* * * * *